US010702915B2

(12) United States Patent
Fujikawa

(10) Patent No.: US 10,702,915 B2
(45) Date of Patent: Jul. 7, 2020

(54) INJECTION DEVICE OF LIGHT METAL INJECTION MOLDING MACHINE

(71) Applicant: SODICK CO., LTD., Kanagawa (JP)

(72) Inventor: Misao Fujikawa, Kanagawa (JP)

(73) Assignee: SODICK CO., LTD., Kanagawa (JP)

( * ) Notice: Subject to any disclaimer, the term of this patent is extended or adjusted under 35 U.S.C. 154(b) by 0 days.

(21) Appl. No.: 16/431,756

(22) Filed: Jun. 5, 2019

(65) Prior Publication Data

US 2019/0375002 A1 Dec. 12, 2019

(30) Foreign Application Priority Data

Jun. 7, 2018 (JP) ..... 2018-109175

(51) Int. Cl.

| | |
|---|---|
| ***B22D 17/30*** | (2006.01) |
| ***B22D 27/00*** | (2006.01) |
| *B22D 27/09* | (2006.01) |
| *B22D 17/28* | (2006.01) |
| *B22D 17/10* | (2006.01) |
| *B22D 17/20* | (2006.01) |
| *B22D 17/32* | (2006.01) |

(52) U.S. Cl.

CPC ..... *B22D 17/30* (2013.01); *B22D 27/003* (2013.01); *B22D 17/10* (2013.01); *B22D 17/2015* (2013.01); *B22D 17/28* (2013.01); *B22D 17/32* (2013.01); *B22D 27/09* (2013.01)

(58) Field of Classification Search

CPC .... B22D 17/10; B22D 17/20; B22D 17/2015; B22D 17/28; B22D 17/30; B22D 17/32; B22D 27/00; B22D 27/003; B22D 27/09

USPC ..... 164/259, 303, 312, 316

See application file for complete search history.

(56) References Cited

U.S. PATENT DOCUMENTS

| | | | | |
|---|---|---|---|---|
| 4,854,370 | A | 8/1989 | Nakamura | |
| 7,066,236 | B2 | 6/2006 | Fujikawa | |
| 10,293,405 | B2 * | 5/2019 | Fu et al. ..... | B22D 17/02 |

FOREIGN PATENT DOCUMENTS

| | | |
|---|---|---|
| JP | 2004358545 | 12/2004 |
| WO | 2004018130 | 3/2004 |

OTHER PUBLICATIONS

"Office Action of Japan Counterpart Application," with machine English translation thereof, dated Apr. 8, 2019, p. 1-6.

* cited by examiner

*Primary Examiner* — Kevin P Kerns
(74) *Attorney, Agent, or Firm* — JCIPRNET

(57) ABSTRACT

An injection device of a light metal injection molding machine includes: a first inert gas storage part creating an inert gas atmosphere around a plunger insertion portion of an injection cylinder; a second inert gas storage part housing surplus molten metal in a melting cylinder and creating an inert gas atmosphere above the molten metal; and a first pressure adjustment part adjusting a pressure in the first inert gas storage part to a pressure equal to or less than a pressure obtained by adding a pressure, which is determined based on a value obtained by multiplying a specific gravity of the molten metal by a height difference between a highest position and a lowest position of the molten metal in a part that includes the inside of the injection cylinder and communicates with the inside of the injection cylinder, and a pressure in the second inert gas storage part.

10 Claims, 1 Drawing Sheet

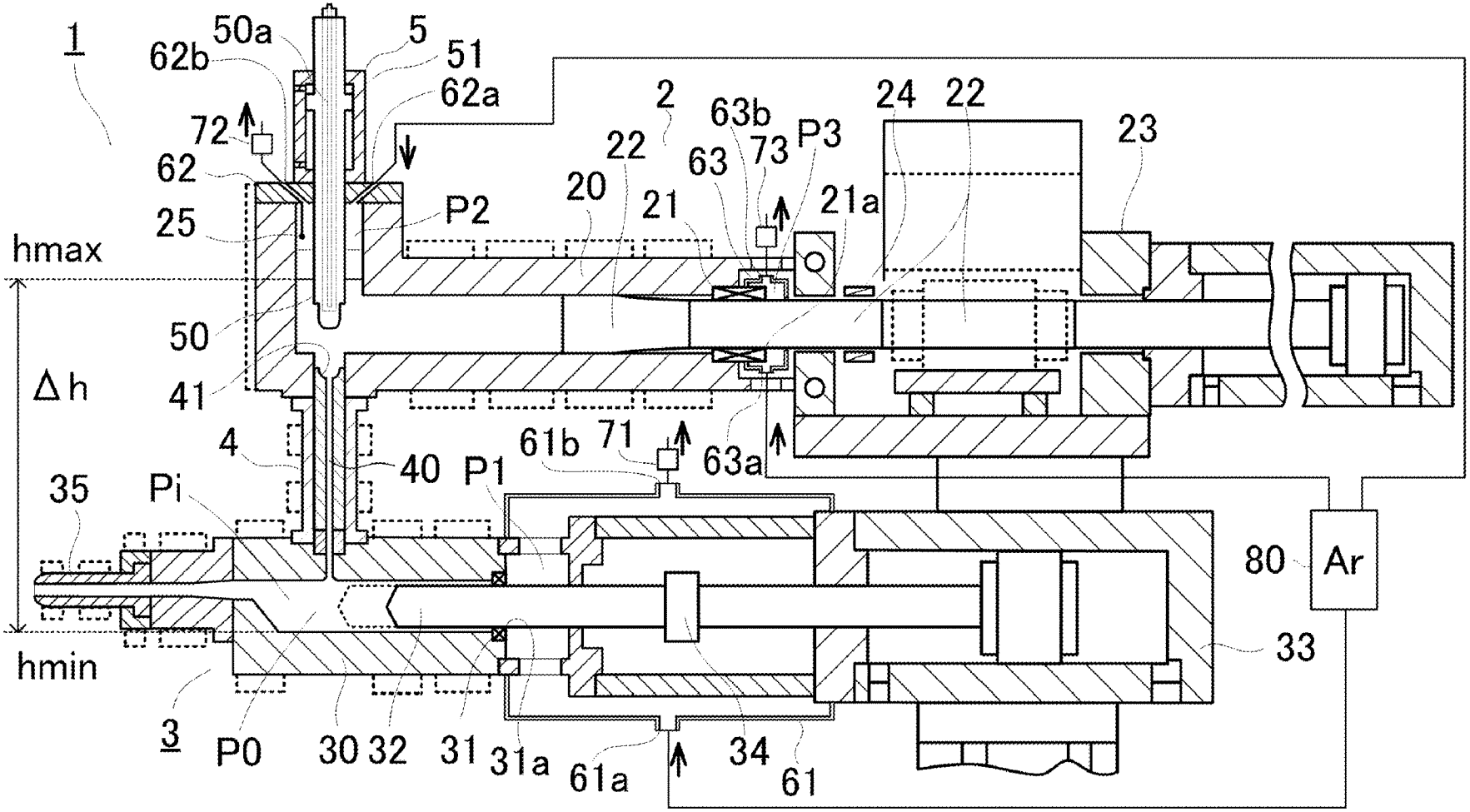
Ar
80
33
23
22
24
21a
P3
73
63b
63
63a
2
21
22
20
71
61b
61
34
61a
31a
31
32
30
P0
3
P1
40
P2
51
62a
5
50a
62b
72
62
25
50
41
4
Pi
35
1
hmax
Δh
hmin

INJECTION DEVICE OF LIGHT METAL INJECTION MOLDING MACHINE

CROSS-REFERENCE TO RELATED APPLICATION

This application claims the priority benefit of Japan Application No. 2018-109175, filed on Jun. 7, 2018. The entirety of the above-mentioned patent application is hereby incorporated by reference herein and made a part of this specification.

BACKGROUND

Technical Field

The disclosure relates to an injection device of a light metal injection molding machine, which melts a material bar of a light metal such as a magnesium alloy or aluminum alloy into molten metal in a melting cylinder, supplies the molten metal into an injection cylinder, and then injects the molten metal into molds with a plunger in the injection cylinder to obtain a molded product.

Description of Related Art

A light metal injection molding machine includes an injection device, a mold clamping device, and a control device for controlling them. The injection device extrudes molten metal of a light metal in an injection cylinder with a plunger and injects it into the molds attached to the mold clamping device.

The die casting device of Patent Document 1 melts a light metal material into molten metal in a melting furnace, etc., supplies the molten metal into a sleeve which corresponds to the injection cylinder, and moves forward the plunger in the sleeve to inject the molten metal into the molds. The molten metal is supplied into the sleeve from a supply port, which opens on the inner circumferential surface of the sleeve, through a supply pipe from the bottom to the top. The sleeve is connected with the molds at one end and connected with a sealed box at the other end. The plunger and a part of its drive part are housed inside the sealed box, and the sealed box is filled with an inert gas. In the die casting device of Patent Document 1, when the supply of the molten metal is completed and the plunger advances and causes the plunger head to exceed the supply port, the inert gas in the sealed box flows into the supply pipe. The inert gas suppresses oxidation of the molten metal adhering to the inner wall of the supply pipe and prevents the supply pipe from being clogged with an oxide that accumulates on the inner wall.

The injection device of the light metal injection molding machine of Patent Document 2 includes a melter that melts a billet corresponding to the material bar of the light metal into molten metal, an injector that injects the molten metal supplied from the melter with a plunger, and a connection member formed with a communication path for communicating the melter and the injector.

The melter has a melting cylinder connected with the communication path at the front end, and the billet is sequentially supplied from an opening at the rear end of the melting cylinder. The melting cylinder uses heat of a heater to strongly melt the billet from the rear end toward the front end. The outer diameter of the billet has a diameter slightly smaller than the inner diameter of the rear end of the melting cylinder. A seal member seals between the rear end of the melting cylinder and the billet, and the seal member is a solidified material of molten metal that is in a somewhat softened state and solidified to a certain extent to prevent backflow of the molten metal. The seal member allows the forward moving billet to slide smoothly.

The injector has an injection cylinder connected with an injection nozzle at the front end, and the plunger is housed from an opening at the rear end of the injection cylinder. The injection cylinder has a cylinder hole and an injection chamber surrounded by the tip end surface of the plunger. When the plunger retracts, the injection cylinder measures and stores a predetermined volume of molten metal in the injection chamber from the connected communication path, and when the plunger advances, the injection cylinder injects the molten metal in the injection chamber from the injection nozzle. The communication path is opened by a backflow prevention device when the molten metal is measured, and closed when the molten metal is injected. The outer diameter of the plunger has a diameter slightly smaller than the inner diameter of the rear end of the injection cylinder. A seal member seals between the rear end of the injection cylinder and the plunger, and the seal member is a solidified material of molten metal that is in a somewhat softened state and solidified to a certain extent to prevent backflow of the molten metal. The seal member allows the plunger that moves forward and backward to slide smoothly.

The injection device of the light metal injection molding machine of Patent Document 2 replaces the gas such as air in the melting cylinder and the injection cylinder with a small amount of inert gas in the preparation stage, and prevents gas such as air from entering with the seal member during molding.

Related Art

Patent Documents

[Patent Document 1] U.S. Pat. No. 4,854,370

[Patent Document 2] U.S. Pat. No. 7,066,236

SUMMARY

Problems to be Solved

In the die casting device of Patent Document 1, the inert gas flows into the supply pipe after the plunger advances. The inert gas in the supply pipe flows into the injection chamber in the sleeve together with the molten metal after the plunger retracts. In addition, the inert gas in the sealed box may slightly enter the injection chamber as it gets caught from between the plunger and the sleeve when the plunger retracts. The inert gas in the injection chamber is injected into the molds together with the molten metal, and if it exceeds the exhaust capacity of the degassing mechanism of the molds, a void is generated in the molded product.

For the injection device of the light metal injection molding machine of Patent Document 2, at least a part of the seal member may be exposed to the outside air such as air and oxidized to form an oxide while the molding cycle is repeated. The seal member containing the oxide may increase the frictional resistance to the billet and the plunger, and may hinder the billet and the plunger from moving smoothly. The seal member that contains an oxide and the seal member that contains no oxide have different temperature ranges in which the molten metal can maintain a softened state with suitable sealing performance. The oxide may make it difficult to perform temperature control for maintaining proper sealing performance of the seal member.

Further, in the injection device of the light metal injection molding machine of Patent Document 2, the surface roughness of the surface is deteriorated by the oxide formed on the surface of the billet in the melter. The billet with gas entering the concave and convex parts of the surface may be supplied into the melting cylinder while entraining the gas.

In view of the above, the disclosure provides an injection device of a light metal injection molding machine, which can move the plunger smoothly, prevent leakage of the molten metal, prevent generation of a void in the molded product, and further supply a material bar of light metal smoothly. According to another aspect of the disclosure will be set forth in the description that follows.

Means for Solving the Problems

In view of the above, an injection device (1) of a light metal injection molding machine according to the disclosure includes: a melter (2) melting a material bar (22) of light metal supplied into a melting cylinder (20) into molten metal in the melting cylinder; an injector injecting the molten metal supplied from the melting cylinder into an injection cylinder (30) with a plunger (32) that advances and retracts in the injection cylinder; a connection member (4) connecting the melter and the injector and formed with a communication path (40) that connects inside of the melting cylinder and inside of the injection cylinder; an inert gas supplier (80) supplying an inert gas; a first inert gas storage part (61) housing a plunger insertion portion (31*a*) for inserting the plunger into the injection cylinder, and at least a part of the plunger exposed to outside of the injection cylinder, to create an atmosphere of the inert gas inside; a second inert gas storage part (62) communicating with the inside of the melting cylinder and housing a surplus of the molten metal in the melting cylinder, to create an atmosphere of the inert gas above the housed molten metal; and a first pressure adjustment part adjusting a pressure (P1) of the inert gas in the first inert gas storage part to a pressure (P0≥P1) equal to or less than a pressure (P0=Pi+P2) obtained by adding a pressure (Pi), which is determined based on a value obtained by multiplying a specific gravity of the molten metal by a height difference (Δh) between a highest position (hmax) and a lowest position (hmin) of the molten metal in a part that includes the inside of the injection cylinder and communicates with the inside of the injection cylinder, and a pressure (P2) of the inert gas in the second inert gas storage part.

Effects

The injection device of the light metal injection molding machine according to the disclosure makes it possible to move the plunger smoothly, prevent leakage of the molten metal, prevent generation of a void in the molded product, and further supply a material bar of light metal smoothly. Generally, the light metal injection molding machine according to the disclosure makes it possible to achieve both high quality and high productivity of the molded product.

BRIEF DESCRIPTION OF THE DRAWINGS

FIG. 1 is a cross-sectional view showing a basic configuration of the injection device of the light metal injection molding machine according to the disclosure.

DESCRIPTION OF THE EMBODIMENTS

A light metal injection molding machine includes an injection device, a mold clamping device, and a control device for controlling them. The injection device is shown in FIG. 1, for example. FIG. 1 shows a basic configuration of the injection device 1 of the light metal injection molding machine according to the disclosure. The mold clamping device and the control device are omitted. The mold clamping device is equipped with a mold device and opens and closes or clamps the mold device. The mold device (not shown) includes a fixed mold and a movable mold, for example. Although the drive sources for driving the devices are not described in detail, various types of drive sources such as hydraulic type, pneumatic type, and electric type may be used as appropriate.

The light metal injection molding machine closes the mold device and further clamps the molds with the mold clamping device, injects and fills molten metal of a light metal toward a cavity space in the mold device with the injection device 1, cools and solidifies the molten metal of the light metal in the mold device, and then opens the molds with the mold clamping device to take out the molded product.

The light metal injection molding machine according to the embodiment has a structure suitable for an injection molding machine in which the molding material is a light metal. In the disclosure, the light metal refers to a metal having a specific gravity of 4 or less. In practice, an aluminum alloy and a magnesium alloy are particularly effective as the molding material. In the case where the molding material is an aluminum alloy, the part to be in contact with the molding material is basically covered with a cermet-based material so as not to be melted.

The injection device 1 of the light metal injection molding machine according to the embodiment shown in FIG. 1 includes a melter 2 having a melting cylinder 20, an injector 3 having an injection cylinder 30, a connection member 4 formed with a communication path 40 for communicating the inside of the melting cylinder 20 and the inside of the injection cylinder 30, and a backflow prevention device 5 for opening and closing the communication path 40. Heaters are wound around the injection cylinder 30, the melting cylinder 20, and the connection member 4.

The melter 2 has a billet extrusion device 23 for pushing a light metal material bar 22 (hereinafter referred to as a billet 22) into the melting cylinder 20. The melting cylinder 20 shown in FIG. 1 is disposed horizontally above the injection cylinder 30. The connection member 4 is connected to the lower portion on the tip end side of the melting cylinder 20. The communication path 40 is open to the lower portion on the tip end side of a cylinder hole of the melting cylinder 20. The billet 22 is in the form of a round bar having a predetermined length and is in turn pushed into the melting cylinder 20. As the billet 22 advances through the heated melting cylinder 20, the temperature rises and the billet 22 melts. A part of the billet 22 that is softened before being melted as the billet 22 advances is enlarged in diameter. The enlarged-diameter part of the billet 22 is slidably in contact with the cylinder hole of the melting cylinder 20 to seal between the melting cylinder 20 and the billet 22.

The inner diameter of the cylinder hole of the melting cylinder 20 is smaller at the rear end portion than the other portions and larger than the outer diameter of the billet 22. The melting cylinder 20 shown in FIG. 1 has a reduced-diameter part 21 at the rear end portion. The inner diameter of the reduced-diameter part 21 is smaller than the inner diameter of the cylinder hole of the melting cylinder 20 and larger than the outer diameter of the billet 22. The melting cylinder 20 and the reduced-diameter part 21 may be integrally formed.

The temperature at the rear end portion of the melting cylinder 20 shown in FIG. 1 is controlled by a heater, so as to generate a seal member between the reduced-diameter part 21 and the billet 22. The seal member is a solidified material of molten metal that is in a somewhat softened state and solidified to a certain extent to prevent backflow of the molten metal. The seal member seals between the rear end portion of the melting cylinder 20 and the billet 22 to prevent leakage of the molten metal. The seal member reduces the friction between the melting cylinder 20 and the billet 22 to allow the billet 22 to move smoothly. The seal member is caught by an annular groove formed on the inner circumferential surface of the reduced-diameter part 21 or a step between the cylinder hole of the melting cylinder 20 and the reduced-diameter part 21, so that the seal member does not come out of the rear end portion of the melting cylinder 20 even under the pressure of the molten metal. The billet 22 may be supplied into the melting cylinder after being preheated by a preheating device 24. After passing through the reduced-diameter part 21, the preheated billet 22 is quickly heated to a temperature that melts the billet 22 into molten metal.

The injector 3 includes an injection nozzle 35 attached to the tip end of the injection cylinder 30, a plunger 32 that moves forward and backward in the injection cylinder 30, and a plunger driving device 33 for driving the plunger 32. The injection cylinder 30 shown in FIG. 1 is disposed horizontally under the melting cylinder 20. The plunger 32 and a drive shaft of the plunger driving device 33 are connected by a coupling 34. The connection member 4 is connected to the upper portion on the tip end side of the injection cylinder 30. The communication path 40 is open to the upper portion on the tip end side of a cylinder hole of the injection cylinder 30.

The inner diameter of the cylinder hole of the injection cylinder 30 is smaller at rear end portion than the other portions and larger than the outer diameter of the plunger 32. The injection cylinder 30 shown in FIG. 1 has a reduced-diameter part 31 at the rear end portion. The inner diameter of the reduced-diameter part 31 is smaller than the inner diameter of the cylinder hole of the injection cylinder 30 and larger than the outer diameter of the plunger 32. The injection cylinder 30 and the reduced-diameter part 31 may be integrally formed.

The temperature at the rear end portion of the injection cylinder 30 shown in FIG. 1 is controlled by a heater, so as to generate a seal member between the reduced-diameter part 31 and the plunger 32. The seal member is a solidified material of molten metal that is in a somewhat softened state and solidified to a certain extent to prevent backflow of the molten metal. The seal member seals between the rear end portion of the injection cylinder 30 and the plunger 32 to prevent leakage of the molten metal. The seal member reduces the friction between the injection cylinder 30 and the plunger 32 to allow the plunger 32 to move smoothly. The seal member is caught by an annular groove formed on the inner circumferential surface of the reduced-diameter part 31 or a step between the cylinder hole of the injection cylinder 30 and the reduced-diameter part 31, so that the seal member does not come out of the rear end portion of the injection cylinder 30 even under the pressure of the molten metal.

The backflow prevention device 5 includes a valve seat 41 formed around the opening of the communication path 40 that is open to the cylinder hole of the melting cylinder 20, a valve stem 50 seated on the valve seat 41 in the melting cylinder 20, and a valve stem driving device 51 for moving forward and backward the valve stem 50 with respect to the valve seat 41. In the backflow prevention device 5 shown in FIG. 1, the valve stem driving device 51 is provided on a second inert gas storage part 62 (to be described later), and the valve stem 50 is provided through the second inert gas storage part 62. The valve seat 41 is formed around the opening of the communication path 40 that is open to the lower portion on the tip end side of the cylinder hole of the melting cylinder 20. The valve stem 50 is lowered and seated on the valve seat 41 to close the communication path 40, and is lifted and separated from the valve seat 41 to open the communication path 40. The valve stem 50 may have a cooling pipe 50*a* through which a cooling medium passes for cooling the tip end of the valve stem 50. For example, immediately before the valve stem 50 is seated on the valve seat 41, the tip end portion may be cooled to form a solidified material of molten metal in a somewhat softened state around the tip end portion. The solidified material at the tip end of the valve stem 50 can be deformed according to the valve seat 41 when the valve stem 50 is seated on the valve seat 41, so as to eliminate a gap between the valve stem 50 and the valve seat 41 to prevent leakage of the molten metal.

The injection device 1 of the light metal injection molding machine according to the embodiment shown in FIG. 1 operates as follows. The backflow prevention device 5 closes the communication path 40. The billet extrusion device 23 supplies the billet 22 into the melting cylinder 20. The billet 22 is melted into molten metal in melting cylinder 20 in advance. The backflow prevention device 5 opens the communication path 40. The plunger 32 in the injection cylinder 30 retracts. The molten metal in the melting cylinder 20 falls into the injection cylinder 30 through the communication path 40. The molten metal is measured by the position where the plunger 32 retracts. Then, the backflow prevention device 5 closes the communication path 40. The plunger 32 advances to inject the molten metal in the injection cylinder 30 into the cavity space of the mold device through the injection nozzle 35.

The molten metal in the melting cylinder 20 can move into the injection cylinder 30 by supplying an inert gas into the melting cylinder 20. Also, the molten metal in the melting cylinder 20 can move into the injection cylinder 30 by pushing the billet 22 into the melting cylinder 20. In the case where the second inert gas storage part 62 (to be described later) is provided in the melting cylinder 20, by equalizing the pressure at which the billet 22 pushes the molten metal and the pressure of the inert gas in the second inert gas storage part 62, the molten metal in the melting cylinder 20 extruded by the billet 22 is supplied into the injection cylinder 30 without being contained in the second inert gas storage part 62. In addition, by supplying the billet 22 into the melting cylinder 20 with the communication path 40 closed, the second inert gas storage part 62 (to be described later) can store the molten metal in advance. By supplying the inert gas to the second inert gas storage part 62 with the communication path 40 opened, the molten metal in the second inert gas storage part 62 moves into the injection cylinder 30 through the communication path 40 due to its own weight or pressure of the inert gas.

A specific configuration of the disclosure will be described hereinafter.

The injection cylinder 30 is connected with a first inert gas storage part 61, which houses a plunger insertion portion 31*a* of the injection cylinder 30 that is for inserting the plunger 32, and at least a part of the plunger 32 exposed to the outside of the injection cylinder 30, to create an inert gas atmosphere therein. The plunger insertion portion 31*a* of the injection cylinder 30 shown in FIG. 1 is an opening of the reduced-diameter part 31 on the side of the plunger driving device 33. The first inert gas storage part 61 shown in FIG. 1 has one end connected to the injection cylinder 30 and the other end connected to the housing of the plunger driving device 33 to seal around the plunger insertion portion 31*a*. In addition, for example, one end of the first inert gas storage part 61 may be connected with the reduced-diameter part 31 of the injection cylinder 30 and the other end may be provided around the outer circumference of the plunger 32 with a slight gap. Even if there is a slight gap in the first inert gas storage part 61, the first inert gas storage part 61 can prevent the outside air from entering simply by supplying a small amount of inert gas continuously to the inside.

The melting cylinder 20 is connected with a second inert gas storage part 62, which communicates with the inside of the melting cylinder 20 and houses the surplus molten metal in the melting cylinder 20, to create an inert gas atmosphere above the housed molten metal. The second inert gas storage part 62 shown in FIG. 1 is provided on the upper portion on the tip end side of the melting cylinder 20 that is disposed horizontally. In addition, the valve stem driving device 51 of the backflow prevention device 5 is provided on the second inert gas storage part 62 shown in FIG. 1, and the valve stem 50 that moves up and down is provided through the inside of the second inert gas storage part 62 to seal the part that houses the surplus molten metal of the melting cylinder 20. The second inert gas storage part 62 has a liquid level sensor 25 that detects the liquid level of the housed molten metal, and the supply amount of the inert gas and the pressure of the inert gas are controlled or the supply of the billet 22 is controlled so that the housed molten metal does not exceed a preset housing capacity. The second inert gas storage part 62 can collect various gases such as inert gas and air that enter the melting cylinder 20, the injection cylinder 30, and the communication path 40.

Further, the melting cylinder 20 is connected with a third inert gas storage part 63, which houses a material bar insertion port 21*a* of the melting cylinder 20 that is for inserting the billet 22, and at least a part of the billet 22 that is about to be inserted into the material bar insertion port 21*a*, to create an inert gas atmosphere therein. The material bar insertion port 21*a* of the melting cylinder 20 shown in FIG. 1 is an opening of the reduced-diameter part 21 on the side of the billet extrusion device. One end of the third inert gas storage part 63 shown in FIG. 1 is connected with the reduced-diameter part 21 and the other end is provided around the outer circumference of the billet 22, which has been preheated by the preheating device 24 and is about to be inserted into the reduced-diameter part 21 of the melting cylinder 20, with a slight gap. Even if there is a slight gap in the third inert gas storage part 63, the third inert gas storage part 63 can prevent the outside air from entering simply by supplying a small amount of inert gas continuously to the inside. In addition, for example, the third inert gas storage part 63 can have one end connected to the melting cylinder 20 and the other end connected to the housing of the billet extrusion device 23 that includes the preheating device 24 to seal around the material bar insertion port. Moreover, since the inert gas does not contain much water, it helps to dry the billet 22.

The first inert gas storage part 61 has a first pressure adjustment part 71 for adjusting the pressure of the inert gas inside to a predetermined pressure P1. The second inert gas storage part 62 has a second pressure adjustment part 72 for adjusting the pressure of the inert gas inside to a predetermined pressure P2. The third inert gas storage part 63 has a third pressure adjustment part 73 for adjusting the pressure of the inert gas inside to a predetermined pressure P3.

For example, the first to third inert gas storage parts 61, 62, and 63 are as shown in FIG. 1. The first inert gas storage part 61 has a first gas supply port 61*a* and a first gas discharge port 61*b*. The second inert gas storage part 62 has a second gas supply port 62*a* and a second gas discharge port 62*b*. The third inert gas storage part 63 has a third gas supply port 63*a* and a third gas discharge port 63*b*.

The first to third gas supply ports 61*a*, 62*a*, and 63*a* are connected to an inert gas supplier 80 that is for supplying an inert gas. The first to third gas supply ports 61*a*, 62*a*, and 63*a* may be connected to the same inert gas supplier 80. The first to third gas supply ports 61*a*, 62*a*, and 63*a* may be connected to first to third inert gas suppliers 80 (not shown) that are provided separately.

The first gas discharge port 61*b* is connected to the first pressure adjustment part 71. The second gas discharge port 62*b* is connected to the second pressure adjustment part 72. The third gas discharge port 63*b* is connected to the third pressure adjustment part 73. The first to third pressure adjustment parts 71, 72, and 73 are relief valves. The relief valve opens the valve to discharge the inert gas inside to the outside when the pressure of the inert gas inside exceeds the predetermined pressure, so as to maintain the pressure of the inert gas inside at the predetermined pressures P1, P2, and P3. The first to third inert gas storage parts 61, 62, and 63 are respectively supplied with a small amount of inert gas from the first to third gas supply ports 61*a*, 62*a*, and 63*a* constantly or at a predetermined timing to remove gas such as air to the outside, and are respectively maintained in inert gas atmospheres at the predetermined pressures P1, P2, and P3.

The first to third pressure adjustment parts 71, 72, and 73 may be respectively provided with first to third pressure sensors (not shown) for respectively detecting the pressures of the inert gases inside the first to third inert gas storage parts 61, 62, and 63. The first to third pressure adjustment parts 71, 72, and 73 may control the supply amounts of the inert gases respectively supplied from the inert gas supplier 80 into the first to third inert gas storage parts 61, 62, and 63 based on the outputs of the first to third pressure sensors, so as to maintain the pressures of the inert gases in the first to third inert gas storage parts 61, 62, and 63 at the predetermined pressures P1, P2, and P3 respectively. The first to third pressure adjustment parts 71, 72, and 73 may open and close the first to third gas discharge ports 61*b*, 62*b*, and 63*b* with an on-off valve, etc. to adjust the discharge amounts of the discharged inert gases based on the outputs of the first to third pressure sensors, so as to maintain the pressures of the inert gases in the first to third inert gas storage parts 61, 62, and 63 at the predetermined pressures P1, P2, and P3 respectively.

The inert gas is, for example, an argon gas (Ar) or a nitrogen gas ($N_2$). The argon gas and the nitrogen gas have different specific gravities to air. The argon gas has a larger specific gravity than air. The argon gas is less reactive to aluminum alloy and magnesium alloy than the nitrogen gas. The inert gas is more preferably the argon gas than the nitrogen gas. When the argon gas is used as the inert gas, the first gas supply port 61*a* may be provided at a position as high as or lower than the first gas discharge port 61*b*, the second gas supply port 62*a* may be provided at a position as high as or lower than the second gas discharge port 62*b*, and the third gas supply port 63*a* may be provided at a position as high as or lower than the third gas discharge port 63*b*.

When the argon gas is used as the inert gas, the second gas supply port 62*a* may be provided at a position lower than the second gas discharge port 62*b* by a pipe member (not shown). By filling the first to third inert gas storage parts 61, 62, and 63 with the argon gas, gas such as air is easily accumulated above. Simply by supplying a small amount of argon gas into the first to third inert gas storage parts 61, 62, and 63 at a predetermined timing, it is possible to easily discharge only the gas such as air from the first to third gas discharge ports 61*b*, 62*b*, and 63*b* above and to maintain the inert gas atmosphere at a predetermined pressure with a small amount of argon gas.

The nitrogen gas has a smaller specific gravity than air. When the nitrogen gas is used as the inert gas, the first gas supply port 61*a* may be provided at a position higher than the first gas discharge port 61*b*, the second gas supply port 62*a* may be provided at a position higher than the second gas discharge port 62*b*, and the third gas supply port 63*a* may be provided at a position higher than the third gas discharge port 63*b*. When the nitrogen gas is used as the inert gas, the second gas discharge port 62*b* may be provided at a position lower than the second gas supply port 62*a* by a pipe member (not shown).

The first to third gas supply ports and the first to third gas discharge ports may be respectively disposed at positions that allow the air in the space to be quickly replaced with the inert gas.

Since the seal member between the injection cylinder 30 and the plunger 32 is in the first inert gas storage part 61 that is maintained in the inert gas atmosphere, no oxide is generated. The plunger 32 can advance and retract smoothly. The injection cylinder 30 can recover the inert gas through the communication path 40 in the second inert gas storage part 62. Since the seal member between the melting cylinder 20 and the billet 22 is in the third inert gas storage part 63 that is maintained in the inert gas atmosphere, no oxide is generated. The billet 22 can advance smoothly. The melting cylinder 20 can recover the inert gas that has entered the concave and convex parts on the surface of the billet 22 in the second inert gas storage part 62. The inert gas does not travel from the melting cylinder 20 to the injection cylinder 30.

The inert gas in the first inert gas storage part 61 may slightly get caught in the retracting plunger 32 and enter the injection cylinder 30. The inert gas in the first inert gas storage part 61 does not enter the injection cylinder 30 if it is at a pressure equal to or less than the pressure that acts on the molten metal in the injection cylinder 30 when the plunger 32 retracts with the communication path 40 opened.

In the injection device 1 of the light metal injection molding machine according to the embodiment shown in FIG. 1, the communication path 40 is open when the plunger 32 retracts. The pressure P1 of the inert gas in the first inert gas storage part 61 is set to a pressure equal to or less than the pressure P0 that acts on the molten metal in the injection cylinder 30 ($P1 \leq P0$). The pressure P0 is obtained by adding a pressure Pi and the pressure P2 of the inert gas in the second inert gas storage part 62 ($P1 \leq P0 = Pi + P2$), wherein the pressure Pi is determined based on a value that is obtained by multiplying the specific gravity s of the molten metal by the height difference $\Delta h$ ($=hmax-hmin$) between the highest position hmax and the lowest position hmin of the molten metal in a part, which includes the inside of the injection cylinder 30 and communicates with the inside of the injection cylinder 30. The pressure P1 may be less than the pressure P0, and it may have a sufficient pressure difference with respect to the pressure P0. The part that includes the inside of the injection cylinder 30 and communicates with the inside of the injection cylinder 30 includes the inside of the injection nozzle 35, the inside of the communication path 40, the inside of the melting cylinder 20, and the inside of the second inert gas storage part 62.

In the injection device 1 according to the embodiment shown in FIG. 1, basically the molten metal in the melting cylinder 20 is sealed. Therefore, in order to compensate for the space of the molten metal that has fallen due to its own weight and moved from the inside of the melting cylinder 20 into the injection cylinder 30, the billet 22 is supplied into the melting cylinder 20 or the inert gas is supplied into the second inert gas storage part 62.

When the molten metal is supplied from the melting cylinder 20 into the injection cylinder 30, if the billet 22 is supplied into the melting cylinder 20, the highest position hmax of the molten metal can be kept constant regardless of the position to which the plunger 32 retracts.

When the molten metal is supplied from the melting cylinder 20 into the injection cylinder 30, if the inert gas is supplied into the second inert gas storage part 62, the highest position hmax of the molten metal is lowered as the plunger 32 retracts. The pressure Pi may be determined considering that the highest position hmax of the molten metal changes at a predetermined position to which the plunger 32 retracts. For example, the highest position hmax of the molten metal at the time when the measurement is completed may be adopted. For example, the highest position hmax of the molten metal at the time when the plunger 32 retracts to the retractable limit position may also be adopted. In addition, for example, the pressure P1 may be set to ½ to ⅓ of the pressure P0, and may be set to a pressure value that has a sufficient pressure difference with respect to the pressure P0.

The highest position hmax of the molten metal in the injection device 1 shown in FIG. 1 is the liquid level of the molten metal in the second inert gas storage part 62 at the time when the plunger 32 retracts to the position where the measurement is completed without the supply of the billet 22. The lowest position hmin of the molten metal in the injection device 1 shown in FIG. 1 is the height of the lower portion in the injection cylinder 30. The height difference $\Delta h$ is the difference between the liquid level of the molten metal in the second inert gas storage part 62 and the height of the lower portion in the injection cylinder 30 ($\Delta h = hmax - hmin$).

The embodiment was chosen in order to explain the principles of the disclosure and its practical application. Many modifications and variations are possible in light of the above teachings. It is intended that the scope of the disclosure be defined by the claims.

What is claimed is:

1. An injection device of a light metal injection molding machine, comprising:

a melter melting a material bar of light metal supplied into a melting cylinder into molten metal in the melting cylinder;

an injector injecting the molten metal supplied from the melting cylinder into an injection cylinder with a plunger that advances and retracts in the injection cylinder;

a connection member connecting the melter and the injector and formed with a communication path that connects inside of the melting cylinder to inside of the injection cylinder;

an inert gas supplier supplying an inert gas;

a first inert gas storage part housing a plunger insertion portion for inserting the plunger into the injection cylinder, and at least a part of the plunger exposed to outside of the injection cylinder, to create an atmosphere of the inert gas inside the first inert gas storage part;

a second inert gas storage part communicating with the inside of the melting cylinder and housing a surplus of the molten metal in the melting cylinder, to create an atmosphere of the inert gas above the molten metal housed in the second inert gas storage part; and a first pressure adjustment part adjusting a pressure of the inert gas in the first inert gas storage part to a pressure equal to or less than a pressure obtained by adding a pressure, which is determined based on a value obtained by multiplying a specific gravity of the molten metal by a height difference between a highest position and a lowest position of the molten metal in a part that includes the inside of the injection cylinder and communicates with the inside of the injection cylinder, and a pressure of the inert gas in the second inert gas storage part.

2. The injection device of the light metal injection molding machine according to claim 1, wherein the first inert gas storage part is formed with a first gas supply port and a first gas discharge port, the first gas supply port is connected to the inert gas supplier, the first gas discharge port is connected to the first pressure adjustment part, and the first pressure adjustment part is a relief valve.

3. The injection device of the light metal injection molding machine according to claim 1, comprising a second pressure adjustment part that adjusts the pressure of the inert gas of the second inert gas storage part to a predetermined pressure.

4. The injection device of the light metal injection molding machine according to claim 3, wherein the second inert gas storage part is formed with a second gas supply port and a second gas discharge port, the second gas supply port is connected to the inert gas supplier, the second gas discharge port is connected to the second pressure adjustment part, and the second pressure adjustment part is a relief valve.

5. The injection device of the light metal injection molding machine according to claim 1, comprising a third inert gas storage part that houses a material bar insertion port of the melting cylinder for inserting the material bar, and at least a part of the material bar that is to be inserted into the material bar insertion port, to create an atmosphere of the inert gas inside the third inert gas storage part.

6. The injection device of the light metal injection molding machine according to claim 5, comprising a third pressure adjustment part that adjusts a pressure of the inert gas of the third inert gas storage part to a predetermined pressure.

7. The injection device of the light metal injection molding machine according to claim 6, wherein the third inert gas storage part is formed with a third gas supply port and a third gas discharge port, the third gas supply port is connected to the inert gas supplier, the third gas discharge port is connected to the third pressure adjustment part, and the third pressure adjustment part is a relief valve.

8. The injection device of the light metal injection molding machine according to claim 1, wherein the first pressure adjustment part adjusts the pressure of the inert gas in the first inert gas storage part at a time when the plunger retracts to a predetermined position to a pressure equal to or less than the pressure obtained by adding the pressure, which is determined based on the value obtained by multiplying the specific gravity of the molten metal by the height difference between the highest position and the lowest position of the molten metal in the part that includes the inside of the injection cylinder and communicates with the inside of the injection cylinder, and the pressure of the inert gas in the second inert gas storage part.

9. The injection device of the light metal injection molding machine according to claim 8, wherein the predetermined position of the plunger is a position of the plunger at a time when the molten metal to be injected has been supplied into the injection cylinder.

10. The injection device of the light metal injection molding machine according to claim 8, wherein the predetermined position of the plunger is a limit position to which the plunger is retractable.

* * * * *